US009233411B2

(12) United States Patent
Takeda

(10) Patent No.: US 9,233,411 B2
(45) Date of Patent: Jan. 12, 2016

(54) WORK TRANSFER APPARATUS WITH CROSSBAR MEMBERS

(71) Applicant: AIDA ENGINEERING, LTD., Sagamihara-shi, Kanagawa (KR)

(72) Inventor: Keisuke Takeda, Sagamihara (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 217 days.

(21) Appl. No.: 13/894,066

(22) Filed: May 14, 2013

(65) Prior Publication Data

US 2013/0309050 A1 Nov. 21, 2013

(30) Foreign Application Priority Data

May 15, 2012 (JP) ..... 2012-111831

(51) Int. Cl.

| | |
|---|---|
| ***B21D 43/10*** | (2006.01) |
| ***B21D 43/00*** | (2006.01) |
| ***B21D 43/05*** | (2006.01) |

(52) U.S. Cl.

CPC ..... *B21D 43/00* (2013.01); *B21D 43/052* (2013.01); *B21D 43/105* (2013.01)

(58) Field of Classification Search

CPC ..... B21D 43/052; B21D 43/105

See application file for complete search history.

(56) References Cited

U.S. PATENT DOCUMENTS

| | | | | |
|---|---|---|---|---|
| 5,842,370 | A | 12/1998 | Hofele et al. | |
| 5,993,143 | A | 11/1999 | Eltze et al. | |
| 6,968,725 | B2 | 11/2005 | Harsch et al. | |
| 7,484,922 | B2 * | 2/2009 | Harsch et al. | 414/749.1 |
| 2002/0029701 | A1 * | 3/2002 | Harsch et al. | 100/139 |
| 2004/0261488 | A1 * | 12/2004 | Lauke et al. | 72/405.11 |

FOREIGN PATENT DOCUMENTS

| | | | |
|---|---|---|---|
| JP | 62-142431 | U | 9/1987 |
| JP | 02-295620 | A | 12/1990 |
| JP | 2003-290851 | A | 10/2003 |
| JP | 2005-118887 | A | 5/2005 |
| JP | 2008-517770 | A | 5/2008 |

OTHER PUBLICATIONS

Notice of Reasons for Rejection Japanese Patent Application No. 2012-111831 dated Oct. 21, 2014 with English translation.

* cited by examiner

*Primary Examiner* — Gerald McClain

(74) *Attorney, Agent, or Firm* — McDermott Will & Emery LLP

(57) ABSTRACT

A work transfer apparatus includes an arm to transfer workpieces to be processed into a machine or carry processed workpieces out of the machine, a crossbar coupled to the arm, and right and left holding devices provided at the left and right sides of the crossbar. The crossbar includes an internal member and right and left cylindrical external members. One of the external members is rotatably provided around an outer surface of the internal member. The apparatus also includes tilt drive devices provided to the arm and connected with the external members. One of the tilt drive devices rotates one of the external members around an axis of a longitudinal direction of the crossbar independently of another of the external members.

11 Claims, 11 Drawing Sheets

(a)

(b)

WORK TRANSFER APPARATUS WITH CROSSBAR MEMBERS

CROSS REFERENCE TO RELATED APPLICATION

The present application claims priority from Japanese patent applications No. 2012-111831 filed on May 15, 2012, the entire contents of which are hereby incorporated by reference.

1. Technical Field

The present invention relates to a work transfer apparatus which transfers a work.

For further details, it relates to the work transfer apparatus which transfers the work between adjacent machines by swinging arm(s) thereof.

2. Description of the Related Art

There is a conventional prior art that, in case of conveying plural works in parallel, can tilt (tilting) the works in the same direction by rotating the works in the same direction around an axis of a crossbar.

In Patent Document 1, a work conveying device (hereinafter, conveying device) is disclosed.

The conveying devices are extended on both sides of a conveying line to convey the works from an upstream press machine to a downstream conveyor belt.

A cross traverse (crossbar) is bridged among transfer devices.

The crossbar is provided with two holding devices.

The holding device is provided rotatably around an axis of the crossbar and is rotated by a tilt drive device on the crossbar.

The transfer devices on both sides cooperate in order to move the crossbar with the holding devices from the press machine to the conveyor belt.

When the holding device moves, the tilt drive device is moved together with the holding device.

In Patent Document 2, another work conveying device which has a pair of pivot arms and a cross-member (crossbar) bridged among the pivot arms is disclosed.

Both a drive device and a toothed belt driven by the drive device are respectively provided on a pair of the pivot arms.

By driving the toothed belt, it is possible to rotate the crossbar around an axis extending in a longitudinal direction of the crossbar.

RELATED ART DOCUMENTS

Patent Documents

[Patent Document 1]

Japanese Patent Application Laid-Open Publication No. 2008-517770

[Patent Document 2]

U.S. Pat. No. 6,968,725 B2 (WO2006/045283)

SUMMARY OF DISCLOSURE

In order to prevent deterioration of machining accuracy due to an inclination of a press slide, it is effective to reduce an imbalance of a load applied to a press machine at the time of pressing in general.

Therefore, even if the same shaped two works are processed, there is a case that those works are processed by reversing directions of each other left and right.

In such case, as the prior art, when transfer devices which tilt the right and left works in the same direction are used, it is difficult to remove the left and right works from dies respectively and place the left and right works into left and right dies of next press machine respectively with suitable posture corresponding to the dies in left and right reversed.

In other words, it is difficult to transfer the works in parallel, and when one attempts to do this, the conveying speed should be lowered.

In the apparatus of Patent Document 1, the holding device is supported and driven by the tilt drive device provided with the crossbar so that the holding device is rotatable around the longitudinal axis of the crossbar.

Therefore, a weight of the crossbar is increased by a weight of the tilt driving device, and a transfer speed and a production efficiency are reduced.

Further in the transfer apparatus of Patent Document 2, a work holding unit rotated around a longitudinal axis of its by rotating whole of the crossbar.

Therefore, it is impossible to control separately right and left control devices.

Further, since the crossbar is rotated, the driving devices for rotating become large.

With that, the present invention is directed to provide a work transfer apparatus which can transfer works at high speed with controlling respectively the posture of the right and left of works.

The work transfer apparatus of the present invention including: an arm moving back and forth between machines in order to transfer work(s); a crossbar being coupled to the arm; a pair of right and left work holding devices being provided at the left and right sides of the crossbar; and tilt drive devices being provided on the arm, respectively controlling the work holding devices to rotate around an axis of a longitudinal direction of the crossbar.

In preferable work transfer apparatus, the arm is provided with a pair of right and left arms, the crossbar is a crossbar unit being bridged among the right and left arms, the crossbar unit includes a long internal member and a pair of right and left, cylindrical external members, both ends of the internal member are respectively supported by the right and left arms, the external members are provided on a periphery of the internal member, and are respectively rotated by a pair of left and right tilt drive devices, the right and left external members are respectively provided with the right and left holding devices, at least one of the external member is rotatable on a periphery of the internal member, outer edges of the external members are respectively coupled of a pair of the tilt drive devices, and inner edges of the external members are respectively extending inwardly along the internal member.

Moreover, it is preferable that the right and left external members are rotatably provided on the periphery of the internal member.

Moreover, one external member is preferable rotatably provided on the periphery of the internal member, and another external member is fixed on or provided with the internal member integrally.

Further, is preferable case, each external member has the bottom part which is coupled to the tilt drive device, and both edges of the internal member are respectively supported by the arms via the bottom parts.

In the work transfer apparatus of the present invention, since the right and left work holding devices independently rotate around the periphery of the crossbar, it is possible to tilt for each of the right and left work holding devices respectively according to the shape of the left and right dies.

Therefore it is possible to improve a transfer speed (See FIGS. 1 and 8).

In the case that such work transfer apparatus is equipped with the arm is provided with a pair of right and left arms, the crossbar is a crossbar unit being bridged among the right and left arms, the crossbar unit includes a long internal member and a pair of right and left, cylindrical external members, both ends of the internal member are respectively supported by the right and left arms, the external members are provided on a periphery of the internal member, and are respectively rotated by a pair of left and right tilt drive devices, the right and left external members are respectively provided with the right and left holding devices, at least one of the external member is rotatable on a periphery of the internal member, outer edges of the external members are respectively coupled of a pair of the tilt drive devices, and inner edges of the external members are respectively extending inwardly along the internal member, it is possible to drive two holding devises separately with the single crossbar unit.

Moreover the external members are rotatably provided to the internal member.

Therefore a driving torque by the tilt drive device on each work holding device is not transmitted to the internal member.

Further, since the internal member is bridged among the right and left arms, the right and left of external members are respectively supported by the right and left arms (not a with cantilever support).

Therefore even if both the internal member and external members are lightweight, it is easy to obtain the necessary strength for a load of movement in a transferring directions and a load of lifting.

Moreover, the tilt drive device, to rotate the external members, can be reduced

Further, since the outer edges of the external members are respectively coupled of the tilt drive devices, and the inner edges of the external members are rotatably supported by the internal member.

Therefore, though the external member is supported and is driven at the ends thereof by each tilt drive device, the rotation of the external member is stable.

In the case that the right and left external members are rotatably provided on the periphery of the internal member, two holding devises can be separately driven with single crossbar unit.

Moreover even though the tilt drive devices drive for rotating two external members, each rotation torque is not transmitted to the internal member.

Therefore, it is not necessary to increase a rigidity of the internal member and the internal member can become compact.

Further, since the outer edges of the external members are respectively coupled of the tilt drive devices, and the inner edges of the external members are rotatably supported by the internal member.

Therefore, the external member is supported and driven to rotate at the edge of the external member by each tilt drive device, the rotation of the external member is stable.

Further, in the case that one external member is rotatably provided on the periphery of the internal member, and another external member is fixed on or provided with the internal member integrally, since the outer edge of one external member is coupled of the tilt drive device, the inner edge of the external member is supported by the internal member, despite of transmitting driving force for a rotation of the internal member via the outer edge of one external member by the tilt drive device, the rotation of one external member is stable.

Moreover, in the case that each external member has the bottom part which is coupled to the tilt drive device, and both edges of the internal member are respectively supported by the arms via the bottom parts, the tilt drive devices can be respectively coupled to the bottom parts with a simple configuration and the internal member can be supported by the arms.

Further, since at least one bottomed cylindrical external member embraces a near portion of the edge of the internal member, the assembly and disassembly of the crossbar unit is easy.

EMBODIMENT FOR CARRYING OUT THE INVENTION

Figure 2:
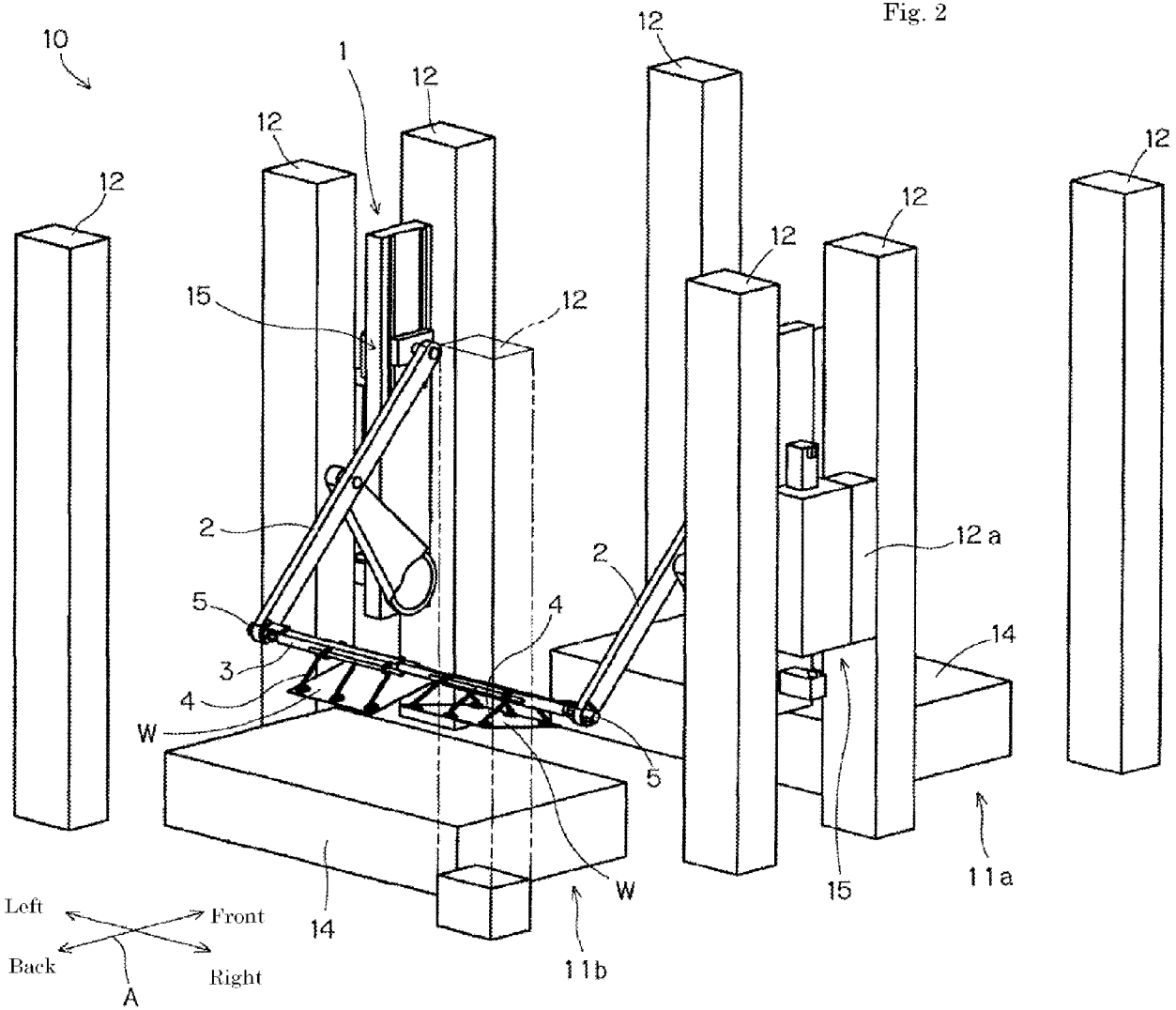
FIG. 2 is an isometric summary view of a press line.

First, the outline of the press line using the work transfer apparatus of the present invention is described using FIG. 2.

In addition, an arrow A in FIG. 2 indicates a direction in which the work W is conveyed.

And that the conveying direction of the work W is referred to as the front and rear directions. The direction in which the arrow A directs front (or downstream), and the work W is conveyed from rear to front.

Further, the left and right directions are based on the left hand side and right hand side when one faces to the front direction.

Two press machines 11*a*, 11*b* shown in FIG. 2, are disposed in a transfer line 10.

The front press machine is shown in "a" of subscript, the rear is shown in "b".

Between these press machines 11*a*, 11*b*, a work transfer apparatus 1 of the present invention is located.

Further the number of press machines, may be three or more.

Moreover instead of the press machine, other machines such as a punching device, or a belt conveyor to transfer the work W, a table to place a work or works before and after processing can be used.

Since the front and rear press machines 11*a*, 11*b* is the same, only the rear press machine 11*b* will be described hereafter, and description of the front press machine is omitted.

The above described press machine 11*b* is a conventional press machine and, for example, is equipped with a rack-shaped frame consisting of a bed, four columns 12 standing up from four places of front and back, right and left, and a crown 13 (see FIG. 3) provided on the top of those columns 12.

On the bed, a bolster 14 is provided.

Moreover, end portions of a crank shaft are rotatably supported by the crown 13. To the crank shaft, a connecting rod is jointed, and a slide (not shown in figure) moves up and down through the connecting rod.

To the bottom face of the slide, an upper tool not shown in figure is attached.

To the top face of the bolster 14, a lower tool not shown in figure is attached.

The work transfer apparatus 1 includes: a pair of arms which moves back and forth between adjacent machines 11*a*, 11*b* in order to transfer works W; a crossbar unit 3 being bridged among a pair of the arms 2, 2; holding devices 4 for holding the work provided on the crossbar unit; and tilt drive devices 5, 5 provided on the arms respectively in order to rotate the holding devices 4, 4.

The pair of arms 2, 2 are arranged on both sides of the conveying line respectively, and driven by arm drive devices 15, 15.

The right and left arm drive devices 15, 15 are provided between the columns 12, 12 of the rear press machine 11*b* and the columns 12, 12 of the front press machine 11*a*.

In this embodiment of the present invention, a bracket 12*a* (see FIG. 3) such as an attachment member is bridged among rear columns 12, 12 of the front press machine 11*a*, and the work transfer apparatus 1 is fixed to the attachment member.

In addition the work transfer apparatus 1 can be fixed to a member so as to be hung from a member or ceiling of a building in which the work transfer apparatus 1 is placed.

In addition, the arm drive devices 15, 15 are described later.

The crossbar unit 3 will be described hereafter using FIG. 1*a*.

The crossbar unit 3 includes: a long internal member 6 of which both ends are supported by a pair of the arms; cylindrical external members 7, 7 being rotatable on a periphery of the internal member 6, and rotated by the tilt drive device 5, 5.

And at least one external member 7 is rotatable by mounted on a periphery of the internal member 6. The wording that the both ends of the internal member 6 are supported by a pair of the arms, means that at least a load applied to the internal member 6 is supported in a state transmittable to the arms 2. That is to say, the both ends of the internal member 6 can be connected not only directly to the arm but also linked indirectly.

Moreover, that the internal member 6 is long means that a length of an axial direction of the internal member 6 is larger than a width of the internal member 6.

Further, at least one external member 7 is rotatable on a periphery of the internal member 6, includes both one case of that while one external member 7 is rotatable on the periphery of the internal member 6 by the tilt drive unit 5 provided on the one arm 2, the other external member 7 is rotatable on the other internal member 6, and another case of that the other external member 7 can also be connected directly to the internal member 6 and linked indirectly.

In the latter case, the internal member 6 rotates together with the other external member 7. And the rotation of the other external member 7 is performed by the other tilt drive device 5 provided on the other arm.

The internal member 6 has: a body part 6*a*; and end parts 6*b*, 6*b* respectively provided both ends of the body part 6*a*.

The body part 6*a* is a (cylindrical) pipe of which cross-sectional shape is circular (see FIG. 1*b*). In addition, the body part 6*a* can be rod-like shape.

The body part 6*a* is formed of a fiber-reinforced plastic, such as carbon fiber reinforced plastic.

As a fiber-reinforced plastic, in addition to carbon fibers, can be used a fiber reinforced plastic with glass fibers, and polyethylene fibers.

The end parts 6*b*, 6*b* are made of aluminum.

In addition, as the end parts 6*b*, 6*b*, steel member, such as iron, stainless steel and the likes can be used.

The end part 6*b* has a cylindrical or column shape, and the region of near the middle in the longitudinal direction of the end part 6*b* is enlarged.

An inner ring of the angular bearing 8 is fitted on an outer periphery of the end part 6*b*.

An inner ring of the angular bearing 8 is set around the end part 6*b* until it abuts against the enlarged portion of the end part 6*b*, and it is positioned by the locking plate 6*c* fixed with bolts or the like from the opposite side so as not to pulled out the end part 6*b*.

The external member 7 has a square tube shape (see FIG. 1*b*), and it rotates around the surface of the internal member 6 by the tilt drive device 5 provided on one arm 2.

The work holding device 4 is attached on the external member 7.

Further, an outer end of the external member 7 is connected to the tilt drive device 5, and an inner end extends inwardly along the internal member 6.

In this way, since external member 7 is provided rotatable to the outer surface of the inner member 6, therefore a load (torque) due to a rotation of the work holding device 4 is not transmitted to the internal member 6.

Further the internal member 6 is bridged among the right and left external members, and furthermore the internal member 6 rotatably supported at two different portions in a longitudinal direction of the external member 7.

Therefore, the left and right external members 7, 7 are not cantilevered, and a crossbar unit of intensity close to both ends support structure can be obtained.

Therefore, even if both the internal and external members 6, 7 are lightweight, it is easy to obtain the necessary strength for a load of movement to the transferring direction and a load of lifting.

Further, since the outer edge of the external member 7 is coupled of the tilt drive device 5, and the inner edge is supported by the internal member 6.

Therefore, despite of transmitting driving force for rotation of the external member 7 via the edge of the external member 7 by the tilt drive device 5, the rotation of the external member 7 is stable.

One or two (FIG. 2 shows two) external member 7 is provided around the internal member 6.

In this embodiment, the external member 7 has a bottom member 7*a* (to be described later). However, even if the external member 7 has a peripheral wall, such as described above, this embodiment can provide effects that torque not transmitting to the internal member 6, and that a rotation driving in cantilever can be stable.

Figure 4:
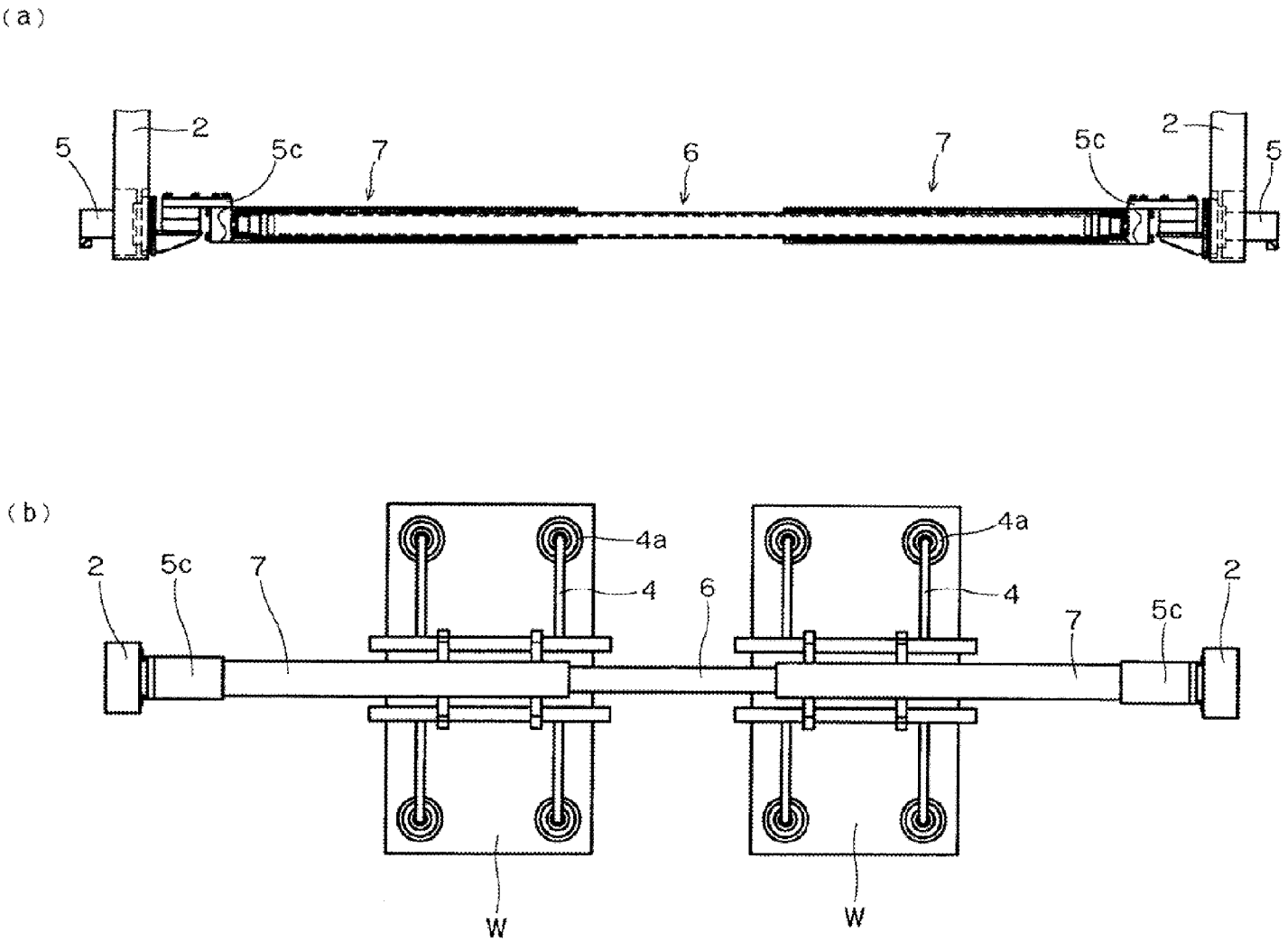
FIG. 4*a* is a front view of the crossbar unit.
FIG. 4*b* is a top view of the crossbar unit shown in FIG. 4*a*.

As shown in FIGS. 2 and 4*a*, the work transfer apparatus 1 has two external members 7, 7 which are rotatably provided around the outer surface of one internal member 6. The work holding devices 4, 4 are respectively mounted on the external members 7, 7.

And the outer ends of the external member 7, 7 are connected to the tilt drive devices 5, 5 respectively, and their inner ends respectively extend inwardly along the internal member 6.

In addition, the members common to the left and right are denoted by the same reference numerals, with omitting the detailed description of both.

Figure 5:
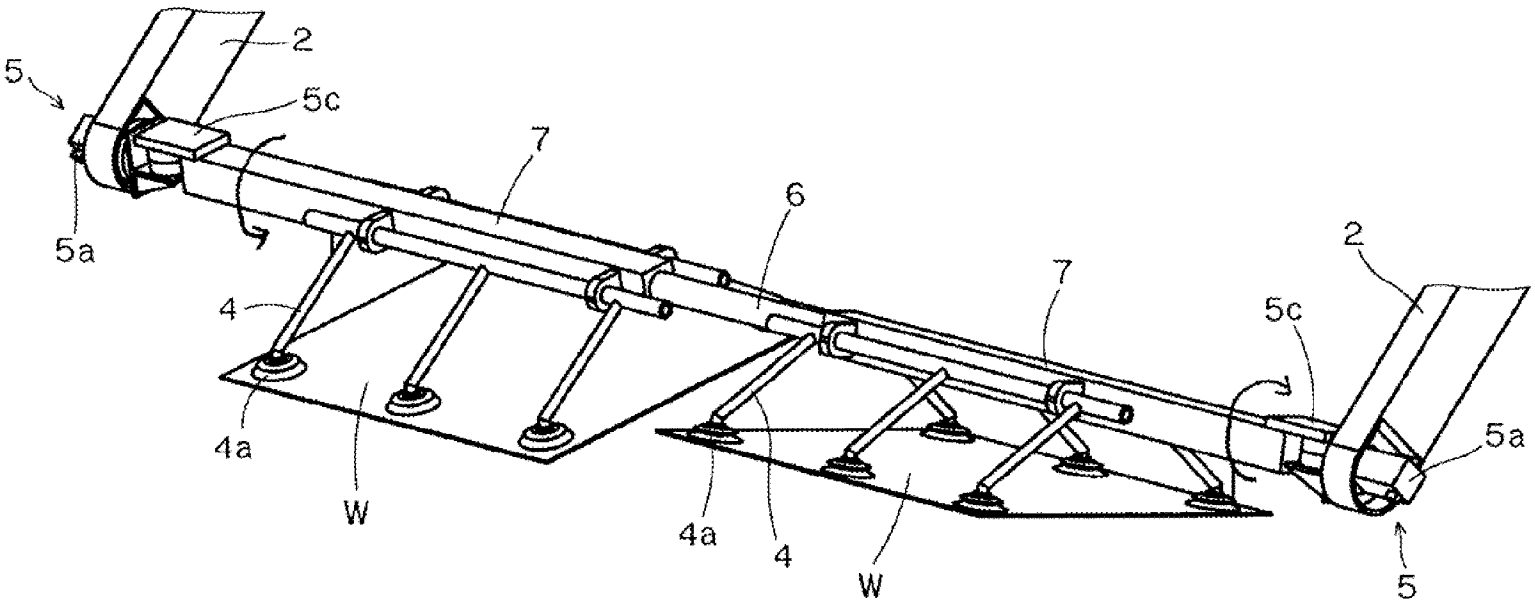
FIG. 5 is an isometric view of the crossbar unit.

Since for one internal member 6, two external members 7, 7 are rotatably disposed, the two holding devices 4, 4 can respectively be rotationally driven by the tilt drive device 5, 5 (see FIG. 5).

In addition, the axial length of two external members 7, 7 can be different.

When a large work W is held, it is preferable to use the long external member 7 in an axial direction.

Also, another embodiment in which one external member 7 is provided rotatably on the outer periphery of the internal member 6, and the other external member 7 is fixed to the internal member 6 or is integrally formed of the internal member 6 can be employed.

In case that the internal member 6 is fixed to the other external member 7, the tilt drive device 5 can drive either the internal member 6 or the external member 7.

The wording that to be integrally formed of the internal member 6 in the other external member 7 includes a case that there is no other external member 7 substantially.

That is, the tilt drive unit 5 provided in the other arm 2, is connected to the internal member 6 without via the external member 7.

And the work holding device 4 is attached to the internal member 6, and is driven to rotate by the tilt drive device 5 around the longitudinal axis of the internal member 6.

Even in such case, it is possible to rotationally drive two work holding device 4, 4 separately by using the one crossbar unit 3.

The outer end part of the internal member 6 is connected to the tilt drive device 5 provided on the other arm, the inner end part supported one the external member 7.

Therefore, the rotation of the internal member 6 is stable at the inner end part connected to the tilt drive device 5.

Returning to FIG. 1*a*, the external member 7 has a bottom part 7*a*.

In addition, a tubular portion extending from the bottom part 7*a* is a peripheral wall 7*b*.

The peripheral wall 7*b* is formed of a fiber-reinforced plastic, such as carbon fiber reinforced plastic.

As a fiber-reinforced plastic, carbon fibers, glass fibers or polyethylene fibers can be used.

The bottom part 7*a* is made of aluminum.

As the bottom part 7*a*, steel member, such as iron or stainless steel can be used.

The bottom member 7*a* is fixed to the bracket 5*c* of the tilt drive device 5 with fasteners such as bolts.

And the end member 6*b* of the internal member 6 is supported by the arm 2 via the bottom part 7*a*.

The external member 7 has a tubular intermediate member 7*c* between the bottom part 7*a* and the peripheral wall 7*b*.

Also, an outer ring of the angular bearing 8 is fitted to a cylindrical intermediate member 7*c*.

On the other hand, an annular sliding bearing 9 is mounted on the inner surface of the distal end of the peripheral wall 7*b* via a mounting bracket 9*a*.

In such case, since the external member 7 has the bottom part 7*a*, it is possible to connect to the tilt drive device 5 to the bottom part 7*a* with a simple configuration and to support the end part 6*b* of the internal member 6 by arm 2 via the bottom part 7*a*.

Also, since the bottomed cylindrical external member 7 embraces a near portion of the outer end of the internal member 6, the assembly and disassembly of the crossbar unit 3 is easy.

The angular bearing 8 rotatably couples the end part 6*b* of the internal member 6 to the bottom part 7*a* of the external member 7.

And they support the load in the axial direction and the radial direction.

Also, the sliding bearing 9 supports the load in the radial direction.

As shown in FIG. 1*b*, the peripheral wall 7*b* of the external member 7 is an square pipe (like a rectangular tube).

For this reason, the external member 7 does not slide expect for the part in contact to the internal member 6, the angular bearing 8 and sliding bearing 9.

Instead of angular type ball bearing 8, a usually known normal ball bearing such as a deep groove ball bearing or a slide bearing which can support a thrust and a radial load can be used.

Further, instead of slide bearing 9, a ball bearing can be used.

Further, the outer surface of the body part 6*a* of the internal member 6 can slide on the external member 7 with contacting directly.

As shown in FIG. 5, the holding device 4 is provided with plural vacuum cups 4*a*.

However, instead of vacuum cups or together with the vacuum cups, another known device using magnetic force or the like can be employed.

The left and right holding devices 4, 4 are respectively controlled by the tilt drive device 5, 5 so that the vacuum cups 4*a* are turned in the predetermined directions according to the motion of the arms 2.

Returning to FIG. 1*a*, the tilt drive device 5 has a servomotor 5*a* mounted on a tip end of the arm 2 or a neighborhood thereof, a reduction gear 5*b* for reducing the rotation of an output shaft (not shown) of the servomotor 5*a* and a bracket 5*c* to which the reducing rotational motion is transferred. The rotational motion of the servomotor 5*a* is controlled by a not shown control device.

These servomotors are provided with encoder for detecting rotating angle, and the position of the work W held by the holding device 5 arms is controlled by counting pulse of the encoder.

Instead of the servomotor, a usually known motor of which rotating angle and rotating velocity can be controlled can be employed.

Figure 3:
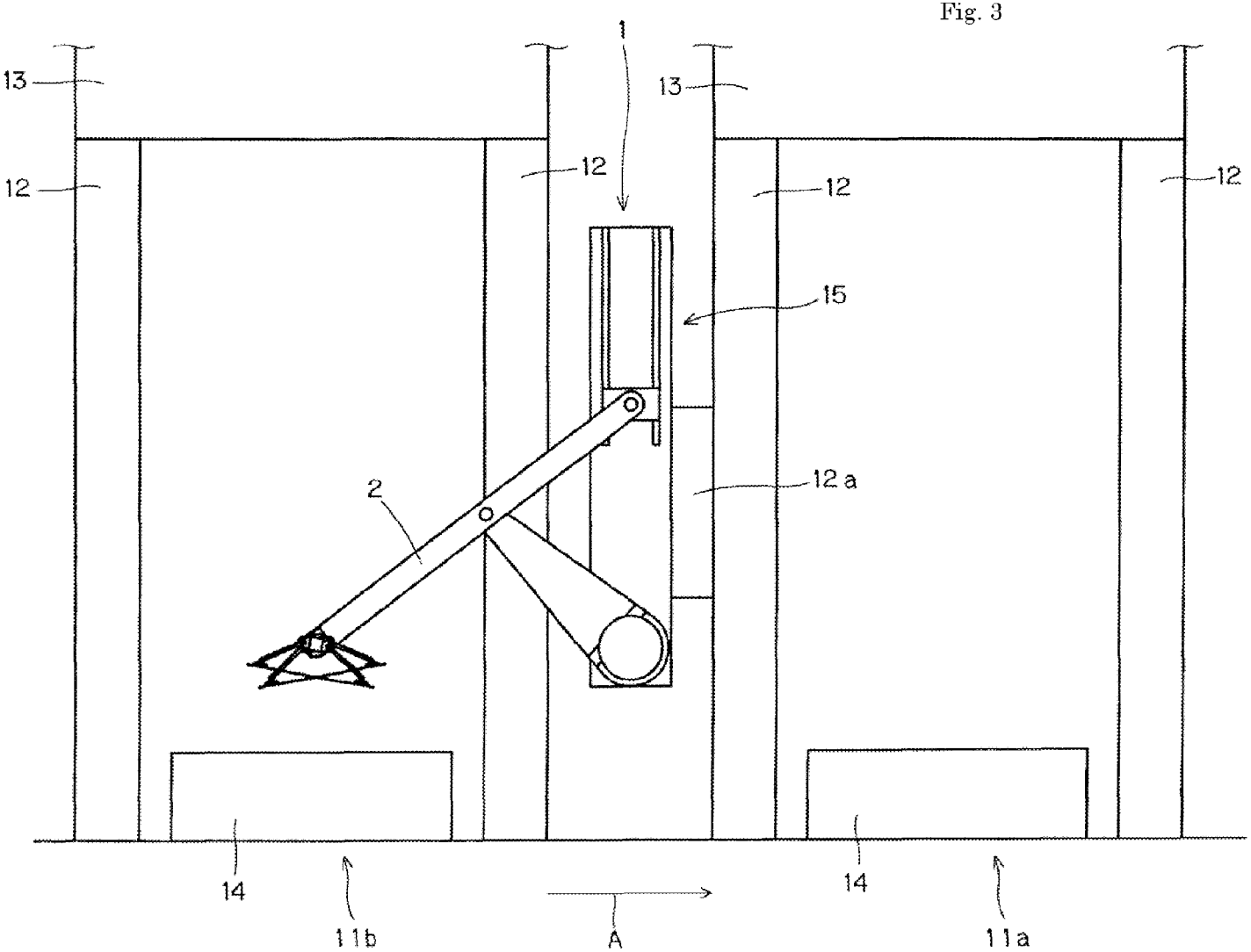
FIG. 3 is a side view of the press line shown in FIG. 2.
Figure 6:
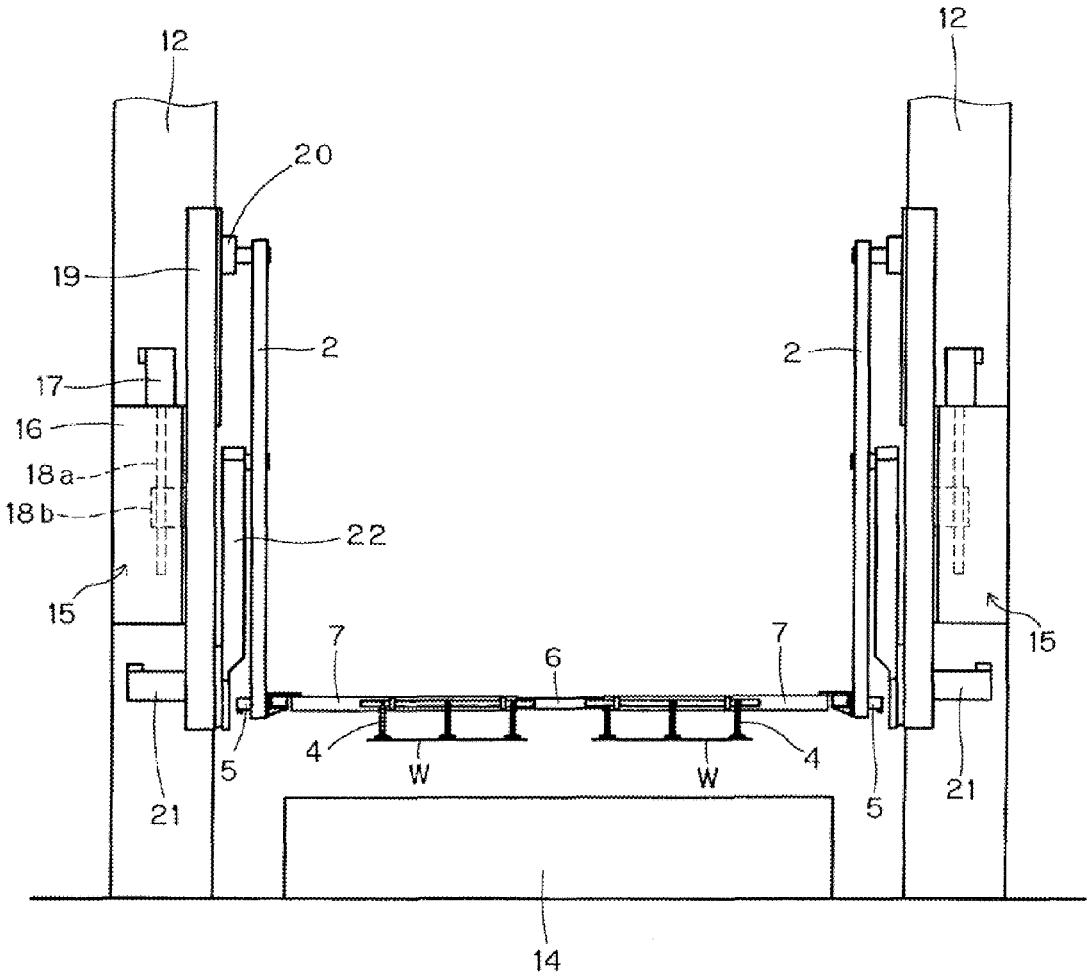
FIG. 6 is a front view of the press machine.

An arm drive device 15 to drive arm 2 is shown in FIG. 3 and FIG. 6.

The arm drive device 15 is a device to swing the arm 2 by mean of a Scott-Russell-Link mechanism.

The arm drive device has a frame 16 attached on the column 12 of the front press machine 11*a*.

The frame 16 is provided with a servomotor 17, and the servomotor drives to rotate a male screw shaft 18*a* of a ball screw vertically extending in the frame.

A female screw 18*b* formed in an up-down frame 19 is screwed on the male screw 18*a*.

The up-down frame 19 is guided by the frame 16 so that the up-down frame 19 goes up and down, and the up-down frame 19 moves up and down by the rotating drive motion of the servomotor 17.

The up-down frame 19 is provided with a shuttle base 20 at upper position thereof.

On the other hand, the up-down frame 19 is provided with transfer servomotor 21 at the bottom thereof.

The transfer servomotor 21 is connected with a base end of the guide arm 22, and the top end of the guide arm 22 is extended in the upper direction.

The guide arm 22 is swung by reciprocating rotating motion in the front-rear directions around the base end, that is to say, around the base end of the Scott-Russell-Link mechanism, as the swing center (axis).

The arm 2 is jointed in rotatable manner at the upper end thereof to the shuttle base 20, and extends downward.

The middle position of the arm 2 is connected with the top end or distal end of the guide arm 22 in the rotatable manner.

As the arm drive device 15, a known mechanism which can reciprocally drive the arms 2, 2 between adjacent machines 11*a*, 11*b* can be employed.

Though, in the above mentioned embodiment, the internal member 6 is capable of rotating to both external members 7, 7, the internal member 6 can be fixe to one of external member 7.

Further, the external member 7 can be formed as one body with the internal member 6, and a rigid pipe or rod can serve as both internal member and external member.

Figure 7:
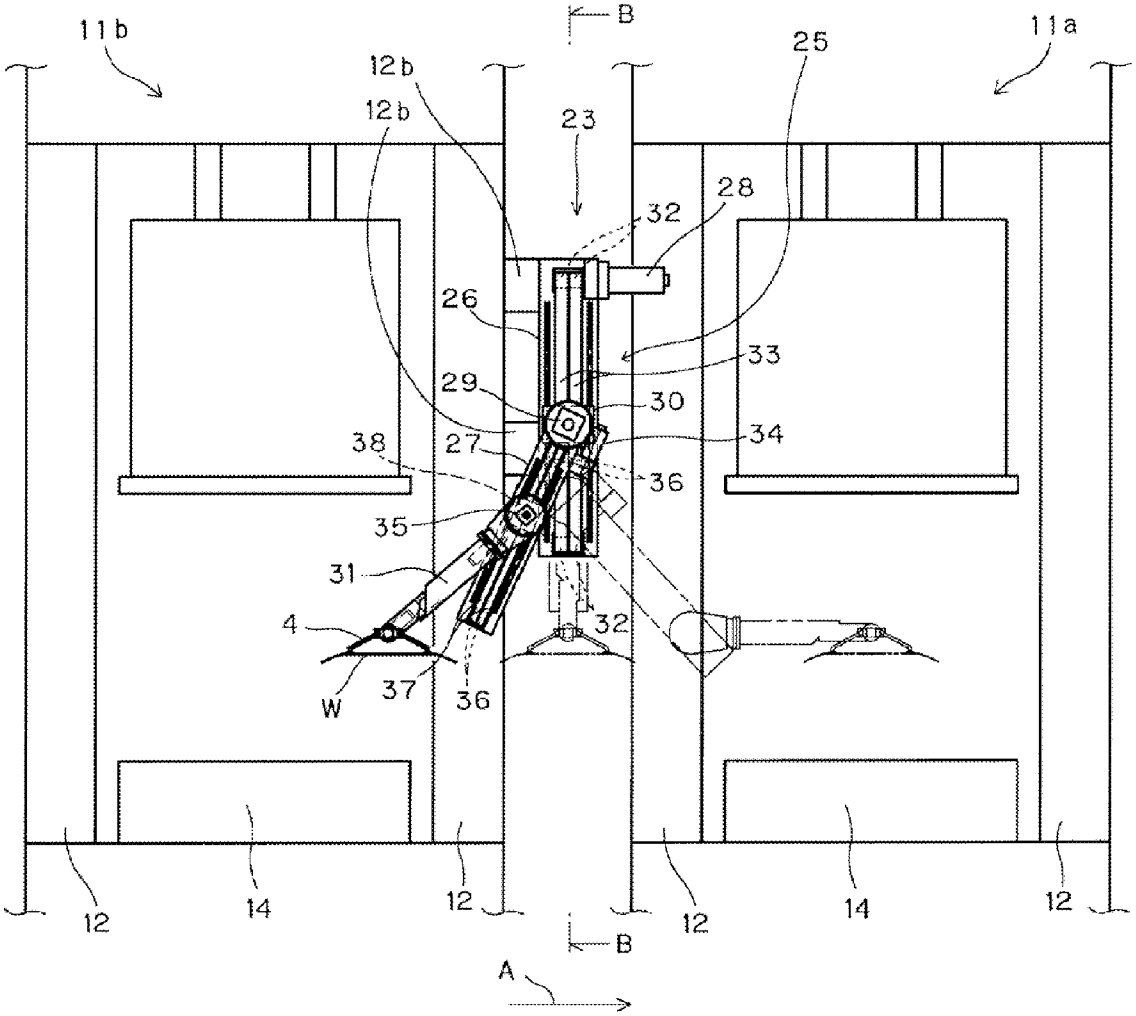
FIG. 7 is a side view showing a state of using the work transfer apparatus.

In FIG. 7, another embodiment of the transfer device of the present invention is shown.

Figure 1:
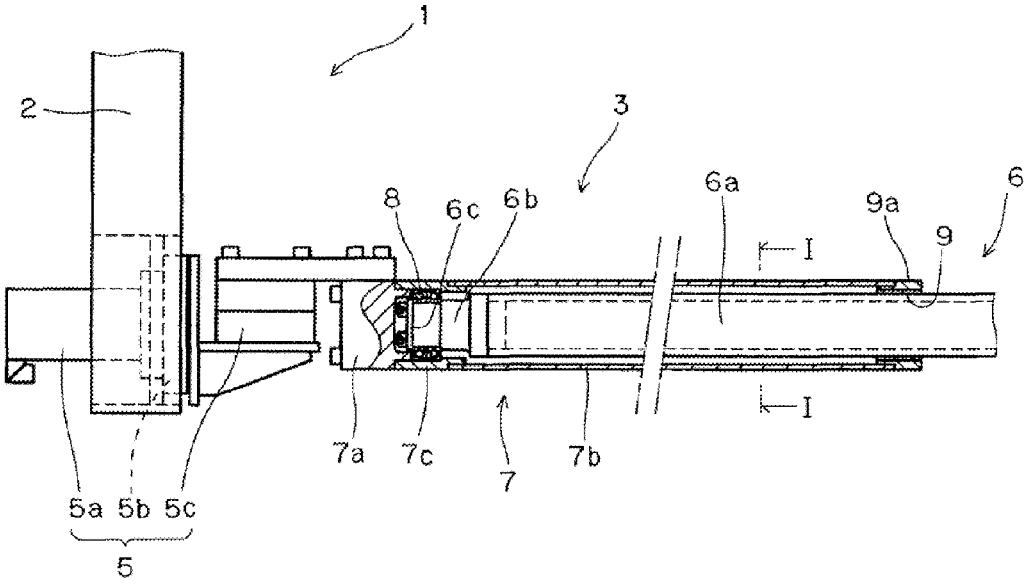
FIG. 1*a* is an outline front view showing an embodiment of the crossbar unit of the present invention.
FIG. 1*b* is an cross-sectional view of the crossbar taken along the line I-I of FIG. 1*a*.
Figure 1:
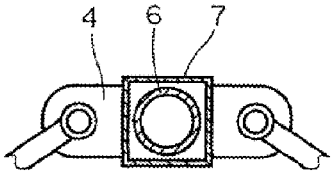

To the same part as the transfer device 1 of FIG. 1, the same numeral is attached, and explanation is omitted.

The transfer device 23 shown in FIG. 7, has a second arm 31 which reciprocates between the front and rear press machines 11*a*, 11*b* to transfer the works W.

Figure 8:
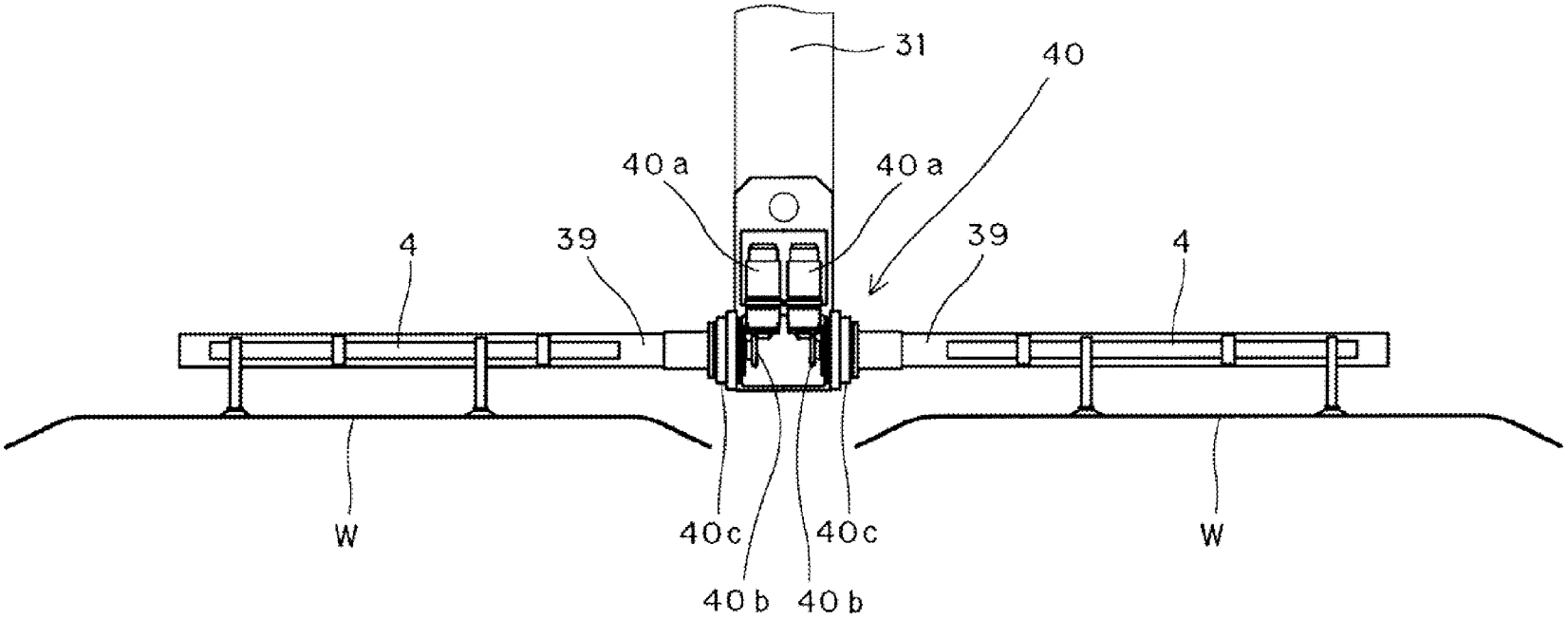
FIG. 8 is a partially enlarged view of the work transfer apparatus of the present invention.

As shown in FIG. 8, the second arm 31 is driven by an arm drive device 25 (explained later).

From the tip end of the second arm 31, two crossbars 39, 39 extend in the left and right directions.

On those crossbars 39, 39, holding device 4, 4 are attached respectively.

Those holding devices 4, 4 are swung around a longitudinal axis of the crossbar 39, 39 individually by tilt drive devices 40, 40 mounted on the second arm 31.

By the way, the transfer device 23 including the one second arm 31 is arranged at the upper position of a line through which the work W is transferred.

This embodiment of the work transfer device 23 has no internal member 6.

Therefore, the crossbar 39 corresponds substantially to the above-mentioned external member 7.

The shape and material of the crossbar are the same as the above-mentioned external member 7.

The tilt drive devices 40, 40 have a driving shaft (not shown) connected to respective output shaft of the servomotors 40*a*, 40*a* which are to be individually operated.

The tilt drive devices 40, 40 are arranged so that each driving shaft rotates around an axis parallel with the longitudinal axis of the second arm 31.

The rotation of the drive shaft is converted to a rotation around a left-right axis by bevel gear 40*b*, 40*b* and transmitted to crossbar 39 through reduction gear 40*c*, 40*c*.

Figure 9:
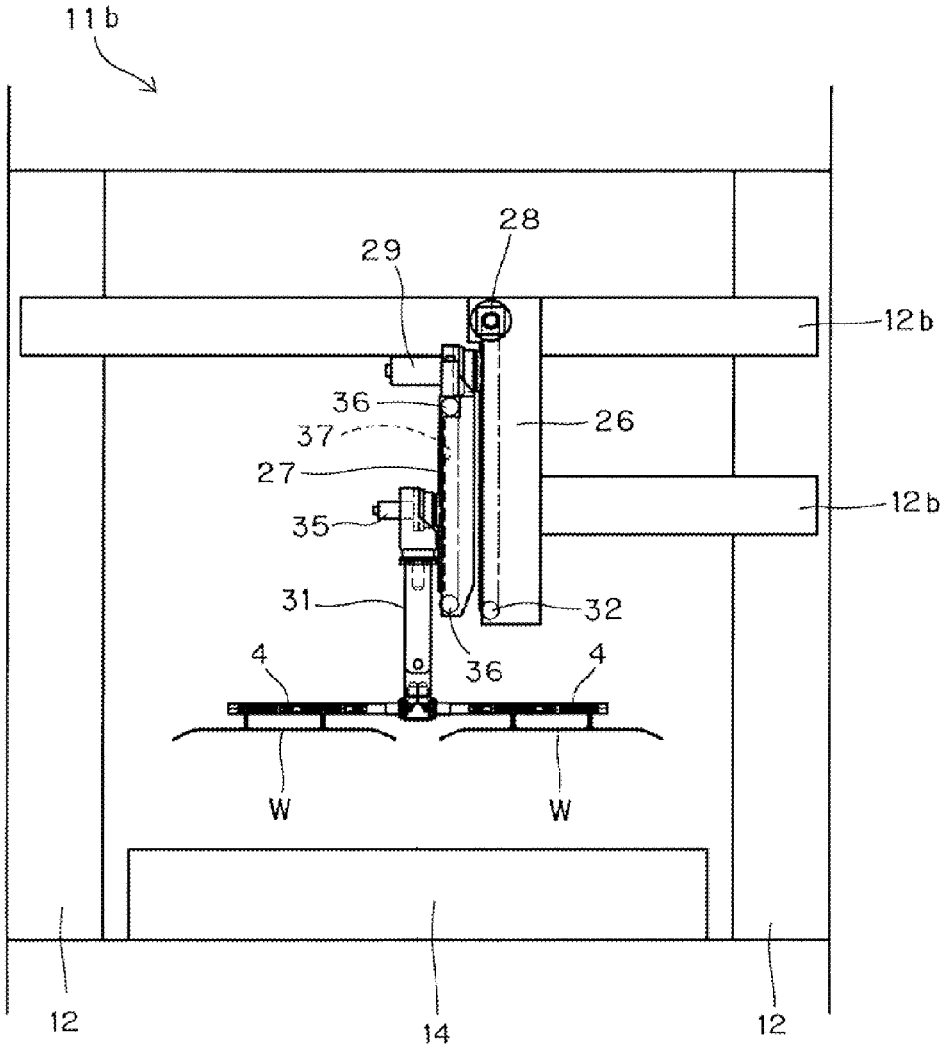
FIG. 9 is an arrow B view of FIG. 7.

Referring to FIG. 7 again, the above-mentioned arm drive device 25 has a frame 26 which is supported by an attachment member such as the bracket 12*b* or the like and extends downward (see FIG. 9).

The bracket 12*b* can be attached on the column 12 of the front press machine 11*a*.

A first arm 27 is supported on the frame 26.

The first arm 27 has a base end which is guided by the frame 25 so that the base end can move vertically, and the first arm 27 is connected to the frame 25 so that the base end can swing around an axis extending left-right directions as facing a transferring direction.

An up-down motor 28 is mounted on the frame 26.

The up-down motor 28 lifts and lowers the up-down base 30 which is guided by the frame 26 in up-and-down directions.

The first arm 27 is mounted on the up-down base 30 with using a swing motor 29.

The frame 26 is provided with upper and lower pulleys 32, 32 at the upper end and lower end thereof, respectively.

Those pulleys are teethed pulleys and wrapped with two teethed belt (timing belt) 33 meshing with teeth of the pulleys 32, 32 in parallel manner.

The up-down base 30 is fixed to the teethed belt 33, 33, and is guided by the frame 26.

The up-down motor 28 can drive the upper pulley to rotate, and therefore, can drive the first arm 27 vertically along the frame 26 through the up-down base 30.

By the way, an output shaft (not shown) of the swing motor 29 is attached on the up-down base 30.

Therefore, due to the rotating motion of the swing motor 29, the first arm 27 can swing to the frame 26.

The first arm 27 supports the second arm 31.

The base end of the second arm 31 is mounted on the first arm 27 movably in the longitudinal direction of the first arm, and is connected to the first arm 27 so that the second arm 31 can rotate around an axis parallel with the swing axis of the first arm 27.

The second arm 31 is moved by a driving force of a movement motor 34 mounted on the first arm 27.

By the way, the second arm 31 is provided with a swing motor 35, and due to the driving force of the swing motor 35, the second arm 31 is swung around an axis parallel with the swing axis of the first arm 27.

The first arm 27 has the same shape as the frame 26.

In the first arm 27, the movement motor 34 is arranged.

In the present embodiment, the second arm 31 moves along the first arm 27 based on the same mechanism as the first arm 27 mentioned above.

Therefore, to the same part, the same number is set to the corresponding part, and detailed explanation is omitted.

The first arm 27 is provided with upper and lower pulleys 36, 36 at the upper end and lower end thereof, respectively.

The upper pulley 36 is driven to rotate by the movement motor 34.

Those pulleys 36, 36 are wrapped with two teethed belt 37, 37 in parallel manner.

The movement base 38 is fixed to the teethed belt 37, 37.

The movement base 38 is guided movably along the first arm 27.

An output shaft of the swing motor 35 is fixed to a base end of the second arm 31.

And an output shaft (not shown) is attached to the movement base 38.

In the arm driving device 25, when the frame 26, the first arm 27 and the second arm 31 are arranged in the longitudinal direction so that one piled up on another, the total length can be shortened.

Then, those members can be extendable in the longitudinal direction.

Therefore, with saving space, the movable range of the work holding device 4 can be enlarged.

On the other hand, in a state that the first arm 27 is moved to a lower end of the frame 26, and is swung to the slide-side (bolster 14-side) of the front press machine 11*a*, the second arm 32 can extend linearly in the horizontal direction.

Therefore, the holding device 4 can be moved in the horizontal direction at the same level as the slide of the press machine 11 to enter into the space under the slide on the press machine 11.

Figure 10:
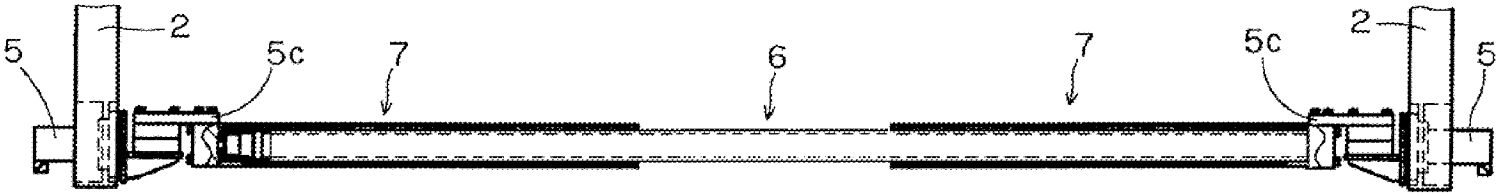
FIG. 10 is a front view of another embodiment of the crossbar unit of the present invention.

In FIG. 10, another embodiment of the crossbar unit of the present invention is shown. In this crossbar unit, one external member 7 is rotatably mounted on a periphery of the internal member 6. And the other external member 7 is fixed on the periphery of an end of the internal member 6. Therefore the internal member 6 rotates together with the other external member 7.

Figure 11:
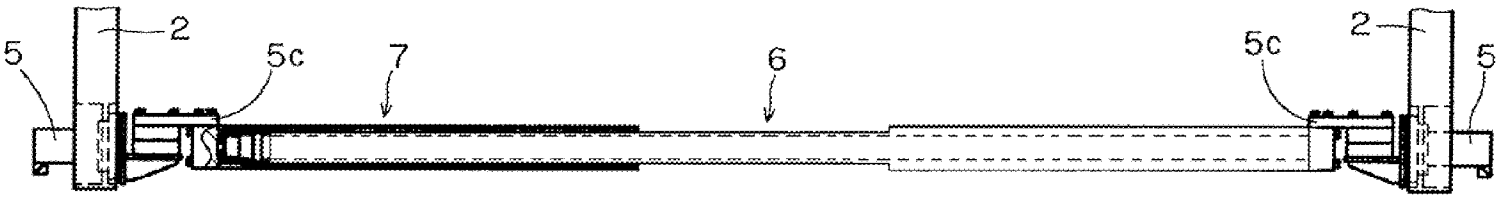
FIG. 11 is a front view of further another embodiment of the crossbar unit of the present invention.

In FIG. 11, further another embodiment of the crossbar unit of the present invention is shown. In this crossbar unit, one external member 7 is rotatably mounted on a periphery of the side (left side in FIG. 11) of one end of the internal member 6. And another side (right side in FIG. 11) of another end of the internal member 6 is not provided with the external member 7. Another end of the internal member 6 is connected to the tilt drive device 5.

EXPLANATION OF MARKS

1 work transfer apparatus
2 arm
3 crossbar unit
4 work holding device
4*a* vacuum cup
5 tilt drive device
5*a* servomotor
5*b* reduction gear
5*c* bracket
6 internal member
6*a* body part
6*b* end part
7 external member
7*a* bottom member
7*b* peripheral wall
7*c* intermediate member
8 angular bearing
9 sliding bearing
10 transfer line
11*a* press machine (front)
11*b* press machine (rear)
12 column
12*a* bracket
13 crown
14 bolster
15 arm drive device
16 frame
17 servomotor
18*a* male screw shaft
18*b* female screw
19 up-down frame
20 shuttle base
21 transfer servomotor
22 guide arm
23 transfer device
25 arm drive device
26 frame
27 first arm
28 up-down motor
29 swing motor
30 up-down base
31 second arm
32 pulley
33 teethed belt
34 movement motor
35 swing motor
36 pulley
37 teethed belt
38 movement base
39 crossbar
40 tilt drive device
40*a* servomotor
40*b* bevel gear
W work

What is claimed is:

1. A work transfer apparatus comprising:

an arm configured to convey workpieces to or from a machine configured to process the workpieces;

a crossbar being coupled to the arm, the crossbar including an internal member, and right and left cylindrical external members, one of the right and left cylindrical external members being rotatably provided around an outer surface of one end of the internal member;

right and left holding devices being attached to the right and left cylindrical external members, respectively, the right and left holding devices being configured to hold the respective workpieces; and tilt drive devices being coupled to the right and left cylindrical external members, one of the tilt drive devices being configured to rotate the one of the right and left cylindrical external members having one of the right and left holding devices, around the outer surface of the one end of the internal member independently of the other of the right and left cylindrical external members having the other of the right and left holding devices.

2. The work transfer apparatus according to claim 1, wherein the arm includes right and left arms, the crossbar is connected between the right and left arms, and ends of the right and left cylindrical external members are coupled to the tilt drive devices, respectively.

3. The work transfer apparatus according to claim 1, wherein the other of the right and left cylindrical external members is rotatably provided around an outer surface of the other end of the internal member, and the other of the tilt drive devices is configured to rotate the other of the right and left cylindrical external members independently of the one of the right and left cylindrical external members.

4. The work transfer apparatus according to claim 3, wherein each external member has a bottom part, each tilt drive device is coupled to the bottom part of corresponding one external member, and both ends of the internal member are respectively supported by the arms via the bottom parts of the external members.

5. The work transfer apparatus according to claim 2, wherein each external member has a bottom part, each tilt drive device is coupled to the bottom part of corresponding one external member, and both ends of the internal member are respectively supported by the arms via the bottom parts of the external members.

6. The work transfer apparatus according to claim 1, wherein the other of the right and left cylindrical external members is fixed on or integrated with the internal member.

7. The work transfer apparatus according to claim 6, wherein each external member has a bottom part, each tilt drive device is coupled to the bottom part of corresponding one external member, and both ends of the internal member are respectively supported by the arms via the bottom parts of the external members.

8. The work transfer apparatus according to claim 1, further comprising a bearing disposed between the one of the right and left cylindrical external members and the internal member.

9. The work transfer apparatus according to claim 1, wherein the holding devices are controlled by the tilt drive devices so that tilts of the holding devices are different from each other.

10. The work transfer apparatus according to claim 1, wherein the external members rotate around the internal member so that a load caused by rotation of the holding devices is not transmitted to the internal member.

11. The work transfer apparatus according to claim 1, wherein the machine is a press machine.

* * * * *